United States Patent [19]

Delong

[11] Patent Number: 4,948,404

[45] Date of Patent: Aug. 14, 1990

[54] LIQUID NITROGEN BY-PRODUCT PRODUCTION IN AN NGL PLANT

[75] Inventor: Bradley W. Delong, West Columbia, Tex.

[73] Assignee: Phillips Petroleum Company, Bartlesville, Okla.

[21] Appl. No.: 389,325

[22] Filed: Aug. 3, 1989

[51] Int. Cl.[5] ..... F25J 3/06

[52] U.S. Cl. ..... 62/23; 62/39

[58] Field of Search ..... 62/9, 11, 23, 24, 36, 62/38, 39

[56] References Cited

U.S. PATENT DOCUMENTS

| | | | |
|---|---|---|---|
| 3,205,669 | 9/1965 | Grossman | 62/23 |
| 3,596,472 | 8/1971 | Streich | 62/28 |
| 4,072,023 | 2/1978 | Springmann | 62/39 |
| 4,115,086 | 9/1978 | Jordan et al. | 62/39 |
| 4,356,014 | 10/1982 | Higgins | 62/39 |
| 4,411,677 | 10/1983 | Pervier et al. | 62/25 |
| 4,435,198 | 3/1984 | Gray | 62/28 |
| 4,619,679 | 10/1986 | DeLong | 62/39 |
| 4,714,487 | 12/1987 | Rowles | 62/24 |
| 4,732,598 | 3/1988 | Rowles | 62/39 |
| 4,746,342 | 5/1988 | DeLong et al. | 62/24 |

*Primary Examiner*—Ronald C. Capossela

*Attorney, Agent, or Firm*—Laney, Dougherty, Hessin & Beavers

[57] ABSTRACT

An improved method of recovering liquid nitrogen as a by-product in a natural gas liquid (NGL) recovery plant is provided. In accordance with the method a plant-separated, nitrogen-rich gas stream is compressed to a super-atmospheric pressure, and the stream is chilled whereby a portion of the nitrogen and other components therein are condensed by passing the stream in an indirect heat exchange relationship with a methane refrigerant stream. The methane refrigerant stream is a portion of the plant methane-rich product gas stream which is expanded, utilized as the refrigerant stream and then recycled to and combined with the plant feed stream.

16 Claims, 2 Drawing Sheets

LIQUID NITROGEN BY-PRODUCT PRODUCTION IN AN NGL PLANT

BACKGROUND OF THE INVENTION

1. Field of the Invention.

The present invention relates to the production of liquid nitrogen as a by-product in a natural gas liquid (NGL) recovery plant, and more particularly, to a method of liquefying nitrogen separated from a natural gas feed stream whereby a portion of the methane-rich residue gas produced is utilized as the refrigerant for condensing the nitrogen.

2. Description of the Prior Art.

Various methods have heretofore been developed and utilized for recovering natural gas liquids from natural gas streams comprised predominantly of methane, significant amounts of ethane and heavier hydrocarbons, and significant amounts of nitrogen. Such methods, as utilized in NGL recovery plants, generally produce a separated methane-rich residue gas stream which is sold or utilized as heating fuel, and an ethane and heavier liquid hydrocarbon product stream. The liquid hydrocarbon stream is usually fractionated to produce propane and butane liquefied petroleum gas (LPG) and pentane and heavier hydrocarbons which are valuable as blending stocks for motor fuels and for other purposes. In addition to the useful components, natural gas feed streams generally also contain undesirable amounts of acid gases, i.e., carbon dioxide and hydrogen sulfide, as well as water, all of which must be removed so that they do not reduce the heating value of the methane-rich residue gas stream or cause other problems. Nitrogen, often present in natural gas feed streams in relatively high amounts, has also been considered an undesirable impurity in the product heating gas stream, and has been removed therefrom in the form of a nitrogen-rich gas stream which has either been vented to the atmosphere or conducted to a point of use such as an enhanced oil recovery project where nitrogen is injected into the oil-containing reservoir.

An example of a prior art method of recovering natural gas liquids while simultaneously rejecting nitrogen from the product residue gas stream is disclosed in U.S. Pat. No. 4,746,342 issued May 24, 1988. In that method, a natural gas feed comprised predominantly of methane and containing significant amounts of ethane and heavier hydrocarbons and nitrogen is separated into a vapor phase and a liquid phase. The separated liquid phase is fractionated to recover ethane and heavier hydrocarbons as liquid products and a pipeline gas as a vapor phase product. The vapor phase from the separation step is sequentially fractionated in second, third and fourth fractionation steps to produce additional product pipeline gas, an in-plant fuel and a substantially pure gaseous nitrogen stream which is vented to the atmosphere or conducted to a point of use.

U.S. Pat. No. 4,411,677 issued Oct. 25, 1983 discloses a process for rejecting nitrogen from a natural gas feed under elevated pressure using a single distillation column and a closed loop methane heat pump which reboils and refluxes the column. The rejected nitrogen is yielded as a gas.

Another example is the method disclosed in U.S. Pat. No. 3,205,669 issued Sept. 14, 1965 wherein helium concentrate, a residue gas rich in methane, natural gas liquids and a substantially pure nitrogen gas stream are produced.

By the present invention, an improved method of separating a natural gas feed stream into at least a hydrocarbon liquid product stream, a methane-rich gas product stream and a substantially pure liquefied nitrogen product stream is provided.

SUMMARY OF THE INVENTION

The present invention provides an improved method of recovering natural gas liquid and removing nitrogen from a natural gas feed stream wherein the nitrogen is recovered as substantially pure liquid. In accordance with the method, a natural gas feed stream comprised predominantly of methane and containing significant amounts of ethane and heavier hydrocarbons and nitrogen is separated into at least a hydrocarbon liquid product stream, i.e., an NGL stream, a methane-rich product gas stream and a nitrogen-rich gas stream. The nitrogen-rich gas stream is compressed to a super-atmospheric pressure at which nitrogen can be condensed at a relatively elevated temperature, and the stream is chilled to minimize the quantity of flash gas created when the stream pressure is reduced to near atmospheric pressure. The chilling of the nitrogen-rich gas stream is accomplished by passing the stream in an indirect heat exchange relationship with a methane refrigerant stream. The methane refrigerant stream is a portion of the methane-rich product gas stream obtained in the natural gas feed stream separation, and it is expanded to reduce its temperature, utilized as the refrigerant stream to chill the nitrogen-rich gas stream and then recycled to and combined with the feed stream.

The liquid nitrogen stream can be flashed to near-atmospheric pressure, and the flash gases produced passed in heat exchange relationship with the compressed nitrogen-rich gas stream to facilitate the chilling thereof. A particularly advantageous technique for recompressing the spent methane-rich product gas utilized as refrigerant is to use stand-by natural gas feed stream compressor capacity for such recompression. When the stand-by capacity is needed for compressing the incoming natural gas feed stream, the nitrogen vapor stream can be vented and the nitrogen liquefaction suspended until the stand-by compressor capacity is again available. Also, the energy produced in expanding the methane-rich product gas used as refrigerant can be applied to compressing the gas prior to the expansion.

It is, therefore, a general object of the present invention to provide an improved method of recovering natural gas liquids and removing nitrogen from a natural gas stream wherein the nitrogen is recovered as a substantially pure liquid product.

Other and further objects, features and advantages of the present invention will be readily apparent to those skilled in the art upon a reading of the description of preferred embodiments which follows when taken in conjunction with the accompanying drawings.

DESCRIPTION OF PREFERRED EMBODIMENTS

Figure 1:
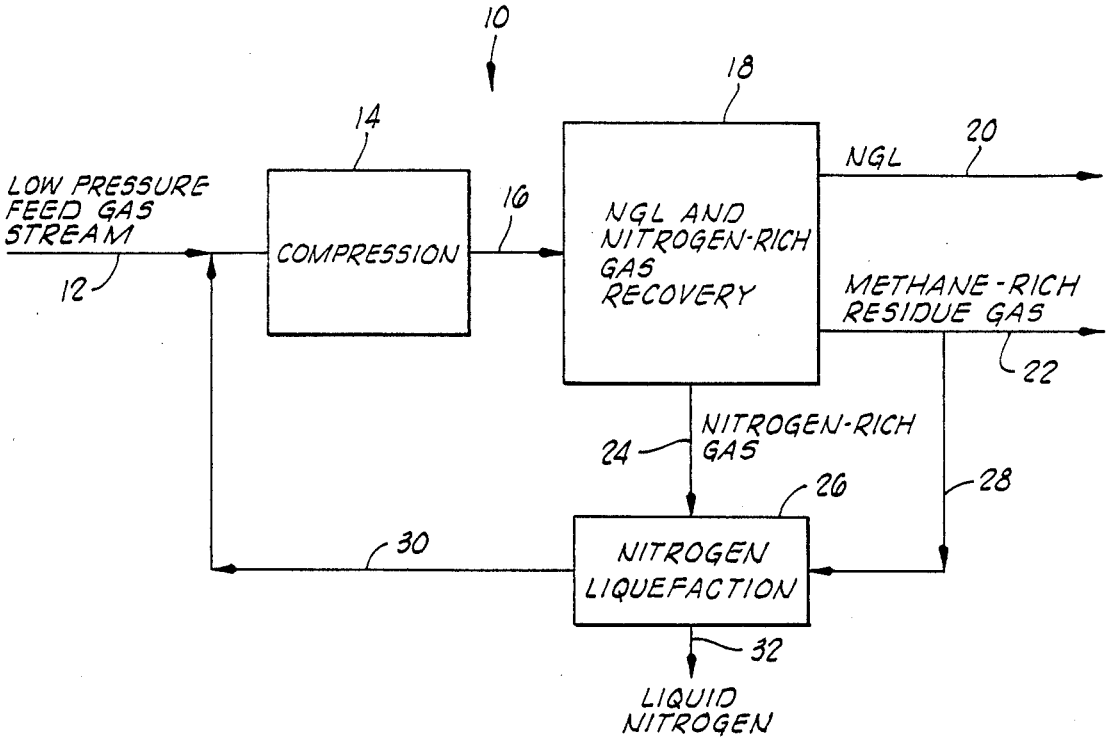
FIG. 1 is a block flow diagram of an NGL and liquid nitrogen recovery plant for carrying out the method of the present invention.

Referring now to the drawings, and particularly to FIG. 1, a natural gas liquid recovery plant for carrying out the method of the present invention is illustrated and generally designated by the numeral 10. An inlet conduit 12 conducts a low pressure natural gas feed stream comprised predominantly of methane and containing significant amounts of ethane and heavier hydrocarbons and nitrogen to the plant 10. In accordance with the usual practice, acid gases such as carbon dioxide and hydrogen sulfide as well as water vapor are removed from the feed stream prior to its being conducted to the plant 10. The feed stream generally has a temperature near ambient temperature, e.g., from about 70° F. to about 90° F., and a low pressure, e.g., from about 15 psia to about 115 psia.

The conduit 12 conducts the feed stream to a compressor station 14 wherein the feed stream is compressed to a superatmospheric pressure, generally in the range of from about 765 to 1015 psia. The feed stream is cooled as it is being compressed by inner stage and after coolers, and generally has a temperature in the range of from about 100° F. to 120° F. when it exits the compressor station 14.

A conduit 16 conducts the compressed feed stream to a system of apparatus 18 wherein a method is carried out for separating the feed stream into at least natural gas liquid (ethane and heavier hydrocarbon liquid), a nitrogen-rich gas stream and a methane-rich residue gas stream. A particularly suitable such method is that described in U.S. Pat. No. 4,746,342 issued May 24, 1988 to DeLong et al. wherein the feed stream is separated by passing it through at least one separation step to separate a vapor phase and a liquid phase; the liquid phase is fractionated to recover ethane and heavier hydrocarbon liquid and a methane-rich residue gas; and the vapor phase from the separation step is sequentially fractionated in second, third and fourth fractionation steps to produce additional methane-rich residue gas, an in-plant fuel and a nitrogen-rich gas stream.

The recovered natural gas liquid, i.e., ethane and heavier hydrocarbon liquid, exits the system 18 by way of a conduit 20. The conduit 20 normally conducts the natural gas liquid to a further fractionation system wherein the liquid is separated into propane and butane LPG products and a pentane and heavier hydrocarbon liquid useful as a blending stock for motor fuels and for other purposes. The methane-rich product gas stream exits the system 18 by way of a conduit 22 which conducts it to a pipeline or other point of sale or use as a heating fuel.

The nitrogen-rich gas stream separated in the system 18 is conducted therefrom by a conduit 24. Typically, the nitrogen-rich gas stream contains in excess of about 98 mole percent nitrogen with the remainder being comprised of methane. While the temperature and pressure of the nitrogen-rich gas stream will vary depending upon the particular method utilized for separating the natural gas feed stream into the various components mentioned, a typical temperature and pressure is 90° F. and 15 psia.

The conduit 24 leads the nitrogen-rich gas stream to a system of apparatus 26 for liquefying the nitrogen by refrigerating and condensing it. As will be described in detail hereinbelow, the refrigerant utilized in the system 26 is a portion of the methane-rich product gas stream which is withdrawn from the conduit 22 and conducted to the system 26 by a conduit 28. After being utilized as refrigerant gas in the system 26, the spent methane-rich product gas is conducted by a conduit 30 to the feed gas inlet conduit 12 wherein it is combined with the feed gas and recompressed in the compressor station 14. Substantially pure liquid nitrogen produced in the system 26 is withdrawn therefrom by a conduit 32. Typically, the substantially pure liquid nitrogen product has a temperature of about −315° F. and a pressure of 20 psia. The liquid nitrogen product can be removed from the location of the plant 10 by refrigerated tank cars and/or tank trucks.

Figure 2:
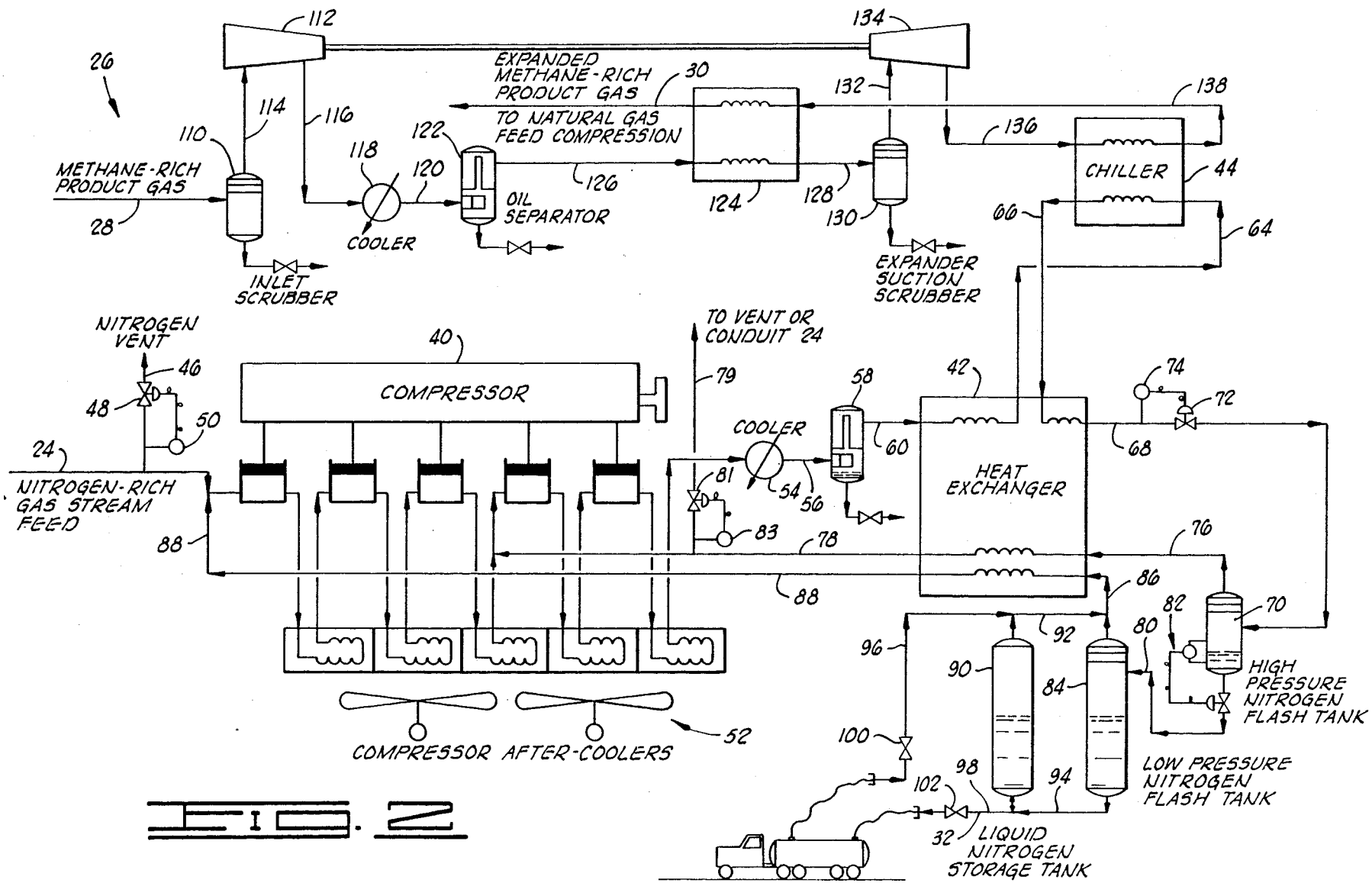
FIG. 2 is a more detailed schematic flow diagram of the nitrogen liquefier portion of the plant of FIG. 1.

Referring now to FIG. 2, the nitrogen liquefaction system 26 is illustrated in detail. The system 26 is basically comprised of a compressor 40 for compressing the nitrogen-rich gas stream to a super-atmospheric pressure at which nitrogen can be condensed by heat exchange with a methane refrigerant stream, and a combination of a heat exchanger 42 and methane chiller 44 for condensing portions of the nitrogen and other components in the nitrogen-rich gas stream. Other apparatus included within the system 26 will be described hereinbelow.

The nitrogen-rich gas stream is conducted by the conduit 24 to the inlet of the compressor 40. A conduit 46 is connected to the conduit 24 and to an atmospheric vent (not shown). A control valve 48 is disposed in the conduit 46 which is operably connected to an upstream pressure controller 50. As is well understood by those skilled in the art, the pressure controller 50 senses the pressure upstream of the compressor 40 so that if an overpressure condition exists at that point in the system for any reason, pressure is relieved by venting the nitrogen-rich gas stream to the atmosphere.

As stated above, the compressor 40 elevates the pressure of the nitrogen-rich gas stream to a temperature at which nitrogen contained therein can be condensed utilizing a methane refrigerant system. Generally, such pressure is in the range of from about 900 psia to about 1200 psia. The compressor 40 includes inner stage and after air coolers, or the equivalent, generally designated by the numeral 52, and a compressor discharge water cooler or the equivalent 54 for cooling the compressed nitrogen-rich gas stream to a temperature in the range of from about 90° F. to about 110° F.

A conduit 56 connected to the discharge of the cooler 54 conducts the nitrogen-rich gas stream to an oil separator 58. The oil separator 58 functions to remove any compressor oil from the nitrogen-rich gas stream, and to thereby eliminate plugging problems such oil might cause in the downstream low temperature equipment. From the separator 58, the nitrogen-rich gas stream is conducted by a conduit 60 to the heat exchanger 42 wherein it is passed in heat exchange relationship with subcooled flash vapors which will be described further hereinbelow. The term "subcooled" is used herein to mean vapors or liquids existing at temperatures below ambient temperature. The nitrogen-rich gas stream is cooled within the heat exchanger 42 to a temperature of about −120° F. whereupon it is discharged from the heat exchanger 42 and conducted by a conduit 64 connected thereto to the methane chiller 44. While flowing through the methane chiller 44 the nitrogen-rich gas stream is further cooled to a temperature of about −220° F. A conduit 66 conducts the nitrogen-rich gas stream and nitrogen and other liquids condensed therefrom from the chiller 44 back to the heat exchanger 42 wherein further cooling to a temperature of about −230° F. takes place.

A conduit 68 conducts the resulting stream of condensed nitrogen and other condensed and gaseous components to a high pressure flash tank 70. A pressure control valve 72 is disposed in the conduit 68 and an upstream pressure controller 74 maintains the nitrogen-rich stream at a high pressure as it flows through the heat exchanger 42, chiller 44 and related conduits. The high pressure flash tank 70 is connected to an intermediate compression stage of the compressor 40 whereby the pressure within the flash tank 70 is maintained in the range of from about 150 psia to about 200 psia. Thus, the pressure exerted on the condensed nitrogen and other components as they flow through the conduit 68 is reduced to a level in the range of from about 50 psi to about 750 psi which causes a substantial portion of the nitrogen and other components to revaporize. Such revaporized nitrogen and other components are separated from the remaining liquid components in the high pressure flash tank 70.

The revaporized components are withdrawn from the flash tank 70 by way of a conduit 76 connected thereto. Because of the pressure reduction and revaporization of the nitrogen and other components, the temperature thereof is reduced to a level in the range of from about −50° F. to about −280° F. The flash vapors, at such temperature, are conducted by the conduit 76 to the heat exchanger 42 wherein they are caused to pass in heat exchange relationship with the previously described nitrogen-rich gas stream flowing therethrough to facilitate its cooling. A conduit 78 conducts the high pressure flash vapors from the heat exchanger 42 to the aforementioned intermediate stage of the compressor 40, and thus the vapors are recycled through the system. A helium purge conduit 79 is connected to the conduit 78 and to an atmospheric vent (not shown) or to the low pressure inlet conduit 24 (also not shown). A control valve 81 is disposed in the conduit 79 which is operably connected to an upstream pressure controller 83. A portion of the high pressure flash vapors flowing through the conduit 78 are either vented to the atmosphere or recycled to the inlet conduit 24 to prevent the buildup of lighter components (primarily helium) in the recycled high pressure flash vapors.

The liquids separated in the high pressure flash tank 70 are withdrawn therefrom by way of a conduit 80 connected thereto. A liquid level controller, generally designated by the numeral 82, controls the liquid level within the flash tank 70. The conduit 80 conducts separated liquid from the flash tank 70 to a low pressure flash tank 84. The flash tank 84 operates at a pressure corresponding to the pressure of the inlet nitrogen-rich gas stream flowing through the conduit 24, i.e., at near atmospheric pressure, and consequently additional nitrogen and other components are vaporized as the separated liquids from the high pressure flash tank 70 flow to and enter the low pressure flash tank 84. Because of the pressure reduction, the flash vapors are further cooled to a temperature in the range of from about −300° F. to about −320° F. The flash vapors are conducted from the low pressure flash tank 84 by a conduit 86 connected thereto.

The conduit 86 conducts the flash vapors from the tank 84 to the heat exchanger 42 wherein they are also passed in heat exchange relationship with the previously described nitrogen-rich gas stream. A conduit 88 connected to the heat exchanger 42 conducts the flash vapors therefrom to the conduit 24 whereby the flash vapors are combined with the nitrogen-rich gas stream being conducted to the compressor 40 and are thereby recycled through the system.

An optional liquid nitrogen storage tank 90 is connected to the low pressure flash tank 84 by vapor and liquid conduits 92 and 94, respectively. Additional vapor and liquid conduits 96 and 98 are connected to the conduits 92 and 94 and to the liquid nitrogen storage tank 90. The conduits 96 and 98 include shut-off valves 100 and 102, respectively, and are connected to a loading rack for loading tank cars and/or tank trucks in a known manner. The conduits 92 and 96 allow displacement and boil-off vapors to be recovered in the system 26.

The methane refrigerant utilized for lowering the temperature of the nitrogen-rich gas stream as it flows through the chiller 44 is a portion of the methane-rich product gas stream produced by the recovery system 18. As previously described, a portion of the methane-rich product gas is flowed in an open cycle through the nitrogen liquefaction system 26 to the low pressure natural gas feed stream inlet. Referring still to FIG. 2, the methane-rich product gas is conducted by the conduit 28 to an inlet scrubber 110. From the inlet scrubber 110, the methane-rich product gas is conducted to a compressor 112 by a conduit 114 connected therebetween. The compressor 112 boosts the pressure of the methane-rich product gas stream to a higher level, e.g., from about 250 psia to about 270 psia. A conduit 116 connected to the discharge of the compressor 112 conducts the methane-rich gas stream to a water cooler or the equivalent 118 wherein the gas stream is cooled to a temperature in the range of from about 90° F. to about 110° F. A conduit 120 connected to the discharge of the cooler 118 conducts the methane-rich gas stream to a compressor oil separator 122, and the gas stream is conducted from the separator 122 to a heat exchanger 124 by a conduit 126 connected therebetween.

While flowing through the heat exchanger 124, the methane-rich product gas stream is passed in heat exchange relationship with the expanded methane-rich product gas stream which has passed through the chiller 44. While flowing through the heat exchanger 124, the compressed methane-rich product gas stream is cooled to a temperature in the range of from about −110° F. to about −130° F. A conduit 128 conducts the cooled methane-rich gas stream from the exchanger 124 to a scrubber 130. From the scrubber 130 the methane-rich gas stream is conducted by a conduit 132 to an expander 134 wherein the methane-rich gas stream is expanded to a near-atmospheric pressure, e.g., a pressure in the range of from about 25 psia to about 125 psia. As a result of the expansion of the methane-rich gas stream, it is further cooled to a temperature in the range of from about −225° F. to about −245° F.

The resultant subcooled methane-rich gas stream is conducted from the expander 134 to the chiller 44 by a conduit 136. While passing through the chiller 44, the subcooled methane-rich gas stream is passed in heat exchanger relationship with the nitrogen-rich stream previously described whereby the nitrogen-rich stream is cooled and condensed. The methane-rich gas stream discharged from the chiller 44 is conducted by a conduit 138 to the heat exchanger 124 wherein it is passed in heat exchange relationship with the compressed methane-rich product gas stream previously described whereby such gas stream is cooled. From the heat exchanger 124 the spent methane-rich product gas stream is conducted by the conduit 30 to the conduit 12 wherein it combines with the low pressure natural gas feed stream flowing to the compressor station 14. Thus, a portion of the methane-rich product gas is expanded and utilized as refrigerant gas to condense the nitrogen-rich gas stream, and the resulting spent low pressure methane-rich product stream is recycled through the compression and recovery parts of the overall process.

A particularly suitable arrangement for recompressing the spent methane-rich product gas stream is to utilize the natural gas feed standby compression capacity normally provided for emergencies and compressor maintenance. Thus, when the standby compressor capacity is utilized for the natural gas feed, the compression of the recycled methane-rich product gas is terminated as is the liquefaction of nitrogen until the standby capacity again becomes available. Also, the energy created by the expansion of the methane-rich product gas stream in the expander 134 is advantageously applied to the booster compressor 112 in a known manner and as schematically illustrated in FIG. 2.

The following table sets forth a material balance in the system 26 when carrying out the method of the present invention. The numbers at the heads of the columns of the table refer to flow lines or items of equipment of FIG. 2 of the drawings.

TABLE I

MATERIAL BALANCE

| | 24 Nitrogen-Rich Gas Stream Feed | 88 Low Pressure Nitrogen Recycle | 40 First Stage Suction | 40 Discharge to Water Cooler 54 | 60 To Heat Exchanger 42 | 64 To Methane Chiller | 66 From Methane Chiller | 68 From Heat Exchanger 42 | 76 High Pressure Nitrogen Flash Vapor | 80 High Pressure Nitrogen Flash Liquid | 86 Low Pressure Nitrogen Flash Vapor |
|---|---|---|---|---|---|---|---|---|---|---|---|
| Helium, mole/hr. | 0.56 | 1.13 | 1.69 | 13.91 | 13.91 | 13.91 | 13.91 | 13.91 | 12.77 | 1.14 | 1.13 |
| Nitrogen, mole/hr. | 227.74 | 99.55 | 327.29 | 519.83 | 519.83 | 519.83 | 519.83 | 519.83 | 201.16 | 318.67 | 99.55 |
| Methane, mole/hr. | 0.47 | 0.01 | 0.48 | 0.48 | 0.54 | 0.54 | 0.54 | 0.54 | 0.06 | 0.48 | 0.01 |
| Ethane, mole/hr. | — | — | — | — | — | — | — | — | — | — | — |
| Propane, mole/hr. | — | — | — | — | — | — | — | — | — | — | — |
| TOTAL, mole/hr. | 228.77 | 100.69 | 329.46 | 534.28 | 534.28 | 534.28 | 534.28 | 534.28 | 213.99 | 320.29 | 100.69 |
| Flow, mmscfd. | 2.084 | 0.917 | 3.001 | 4.866 | 4.866 | 4.866 | 4.866 | 4.866 | 1.949 | 2.917 | 0.917 |
| Flow, #/hr. | 6,390 | 2,793 | 9,183 | 14,626 | 14,626 | 14,626 | 14,626 | 14,626 | 5,687 | 8,939 | 2,793 |
| Temp., °F. | 90 | 90 | 90 | 120 | 100 | −120.8 | −220 | −231 | −268.6 | −268.6 | −315.6 |
| Pressure, psia. | 15 | 15 | 15 | 990 | 980 | 965 | 960 | 955 | 185 | 185 | 20 |
| Enthalpy, BTU/hr. | 1,417,677 | 630,581 | 2,038,258 | 3,302,510 | 3,222,150 | 2,240,901 | 1,380,540 | 1,245,081 | 700,087 | 544,994 | 334,607 |

| | 94 Liquid Nitrogen Product | 78 High Pressure Nitrogen Recycle from Heat Exchanger 42 | 79 Helium Purge | 28 Methane-Rich Product Gas to Compressor 112 | 116 From Compressor 112 | 126 To Heat Exchanger 124 | 132 To Expander 134 | 136 From Expander 134 | 138 From Methane Chiller 44 | 30 To Natural Gas Feed Compression |
|---|---|---|---|---|---|---|---|---|---|---|
| Helium, mole/hr. | 0.01 | 12.77 | 0.55 | 0.04 | 0.04 | 0.04 | 0.04 | 0.04 | 0.04 | 0.04 |
| Nitrogen, mole/hr. | 219.12 | 201.16 | 8.62 | 34.42 | 34.42 | 34.42 | 34.42 | 34.42 | 34.42 | 34.42 |
| Methane, mole/hr. | 0.47 | 0.06 | 0 | 1,058.32 | 1,058.32 | 1,058.32 | 1,058.32 | 1,058.32 | 1,058.32 | 1,058.32 |
| Ethane, mole/hr. | — | — | — | 5.19 | 5.19 | 5.19 | 5.19 | 5.19 | 5.19 | 1.59 |
| Propane, mole/hr. | — | — | — | 0.03 | 0.03 | 0.03 | 0.03 | 0.03 | 0.03 | 0.03 |
| TOTAL mole/hr. | 219.60 | 213.99 | 9.17 | 1,098.00 | 1,098.00 | 1,098.00 | 1,098.00 | 1,098.00 | 1,098.00 | 1,098.00 |
| Flow, mmscfd. | 2.000 | 1.949 | 0.084 | 10.000 | 10.000 | 10.000 | 10.000 | 10.000 | 10.000 | 10.000 |
| Flow, #/hr. | 6,146 | 5,687 | 244 | 18,000 | 18,000 | 18,000 | 18,000 | 18,000 | 18,000 | 18,000 |
| Temp., °F. | −315.6 | −90 | 90 | 100 | 185.5 | 100 | −120 | −238 | −150.9 | 89.7 |
| Pressure, psia. | 20 | 180 | 180 | 200 | 270 | 260 | 250 | 31 | 28 | 25 |
| Enthalpy, BTU/hr. | 210,387 | 1,270,060 | 54,425 | 5,249,360 | 6,093,088 | 5,219,720 | 3,061,500 | 2,217,722 | 3,078,133 | 5,236,353 |

While specific materials, modes of operation and items of equipment have been described herein for purposes of this disclosure, it is to be understood that such specific descriptions are for the purpose of illustration only and are not limiting of the invention. Further, while numerous changes in the method steps and arrangements of equipment can be made by those skilled in the art, such changes are encompassed within the spirit of this invention as defined by the appended claims.

What is claimed is:

1. In a method of recovering natural gas liquids and removing nitrogen from a natural gas feed stream wherein said feed stream is compressed to a super-atmospheric pressure, subcooled and separated into at least a natural gas liquid stream, a methane-rich product gas stream and a nitrogen-rich gas stream, the improvement whereby said nitrogen-rich gas stream is liquefied comprising the steps of:

(a) compressing said nitrogen-rich gas stream to a super-atmospheric pressure at which nitrogen in said stream can be condensed;

(b) chilling said compressed nitrogen-rich gas stream whereby portions of the nitrogen and other components in said stream are condensed by passing said stream in an indirect heat exchange relationship with a methane refrigerant gas stream;

(c) expanding a portion of said methane-rich product gas stream to reduce the temperature thereof;

(d) utilizing said expanded methane-rich product gas stream as said refrigerant gas stream in step (b); and then (e) recycling said expanded product gas stream to said feed stream.

2. The method of claim 1 wherein said portion of said methane-rich product gas stream is compressed and cooled prior to being expanded in accordance with step (c).

3. The method of claim 2 wherein said compressed and cooled methane-rich product gas stream prior to being expanded in accordance with step (c) is passed in an indirect heat exchange relationship with said methane-rich gas stream after it is expanded and after it is utilized as said refrigerant gas stream in accordance with step (d).

4. The method of claim 1 which is further characterized to include the steps of:

reducing the pressure of the condensed nitrogen and other components produced in step (b) in one or more stages to near atmospheric pressure whereby flash vapors and substantially pure liquid nitrogen are produced; and separating said flash vapors from said liquid nitrogen.

5. The method of claim 4 wherein said separated flash vapors are passed in heat exchange relationship with said compressed nitrogen-rich gas stream of step (a) to facilitate the chilling thereof in accordance with step (b).

6. The method of claim 5 wherein said portion of said methane-rich product gas stream is compressed and cooled prior to being expanded in accordance with step (c).

7. The method of claim 6 wherein said compressed and cooled methane-rich product gas stream prior to being expanded in accordance with step (c) is passed in an indirect heat exchange relationship with said methane-rich gas stream after it is expanded and after it is utilized as said refrigerant gas stream in accordance with step (d).

8. A method of separating a natural gas feed stream comprised predominantly of methane and containing significant amounts of ethane and heavier hydrocarbons and nitrogen into at least a hydrocarbon liquid product stream, a methane-rich gas product stream and a liquid nitrogen product stream comprising the steps of:

(a) compressing said natural gas feed stream to a super-atmospheric pressure at which ethane and heavier hydrocarbons can be condensed;

(b) subcooling said compressed feed stream;

(c) separating said compressed and subcooled feed stream into at least a methane-rich product gas stream, a nitrogen-rich gas stream and an ethane and heavier hydrocarbon-rich liquid stream;

(d) compressing said nitrogen-rich gas stream to a super-atmospheric pressure at which nitrogen in said stream can be condensed at a relatively elevated temperature;

(e) chilling said compressed nitrogen-rich gas stream whereby a portion of the nitrogen and other components in said stream are condensed by passing said stream in an indirect heat exchange relationship with a methane refrigerant gas stream;

(f) expanding a portion of said methane-rich product gas stream to reduce the temperature thereof;

(g) utilizing said expanded methane-rich product gas stream as said refrigerant gas stream in step (b); and then (h) recompressing said expanded methane-rich product gas stream with said feed stream.

9. The method of claim 8 wherein said portion of said methane-rich product gas stream is compressed and cooled prior to being expanded in accordance with step (f).

10. The method of claim 9 wherein said compressed and cooled methane-rich product gas stream prior to being expanded in accordance with step (f) is passed in an indirect heat exchange relationship with said methane-rich gas stream after it is expanded and after it is utilized as said refrigerant gas stream in accordance with step (g).

11. The method of claim 8 which is further characterized to include the steps of:

reducing the pressure of the condensed nitrogen and other components produced in step (e) to near atmospheric pressure in one or more stages whereby flash vapors and substantially pure liquid nitrogen are produced; and separating said flash vapors from said liquid nitrogen.

12. The method of claim 11 wherein said separated flash vapors are passed in heat exchange relationship with said compressed nitrogen-rich gas stream of step (f) to facilitate the chilling thereof in accordance with step (e).

13. The method of claim 12 wherein said portion of said methane-rich product gas stream is compressed and cooled prior to being expanded in accordance with step (f).

14. The method of claim 13 wherein said compressed and cooled methane-rich gas stream prior to being expanded in accordance with step (f) is passed in an indirect heat exchange relationship with said methane-rich gas stream after it is expanded and after it is utilized as said refrigerant gas stream in accordance with step (g).

15. The method of claim 14 wherein the energy produced in the expansion of said compressed and cooled methane-rich gas stream is applied to compressing said gas stream prior to its expansion.

16. The method of claim 15 wherein recompressing said expanded methane-rich product gas stream in accordance with step (h) is carried out using standby feed stream compressor capacity.

* * * * *

UNITED STATES PATENT AND TRADEMARK OFFICE

CERTIFICATE OF CORRECTION

PATENT NO. : 4,948,404

DATED : August 14, 1990

INVENTOR(S) : Bradley W. Delong

It is certified that error appears in the above-identified patent and that said Letters Patent is hereby corrected as shown below:

Column 5, line 27, after "-" and before the "5", insert --2--.

Signed and Sealed this

Seventh Day of January, 1992

*Attest:*

HARRY F. MANBECK, JR.

*Attesting Officer*

*Commissioner of Patents and Trademarks*